US005515902A

United States Patent [19]

Hoffman

[11] Patent Number: 5,515,902

[45] Date of Patent: May 14, 1996

[54] REINFORCED SHUTTER PANEL

[76] Inventor: Robert E. Hoffman, 5618 Riviera Dr., Coral Gables, Fla. 33146

[21] Appl. No.: 334,140

[22] Filed: Nov. 4, 1994

[51] Int. Cl.[6] ..... E06B 3/12

[52] U.S. Cl. ..... 160/235; 160/236

[58] Field of Search ..... 160/133, 236, 160/235, 232, 23.1, 32, 36

[56] References Cited

U.S. PATENT DOCUMENTS

| | | | |
|---|---|---|---|
| 4,173,247 | 11/1979 | Piana | 160/236 |
| 4,343,340 | 8/1982 | Paule | 160/236 |
| 4,432,591 | 2/1984 | Rinkewich | 160/235 X |
| 4,601,953 | 7/1986 | Haffer | 160/236 X |
| 4,690,193 | 9/1987 | Morrison et al. | 160/235 X |
| 4,723,588 | 2/1988 | Ruppel | 160/235 X |
| 4,979,553 | 12/1990 | Lowry et al. | 160/236 X |
| 5,322,108 | 6/1994 | Hoffman | 160/236 |
| 5,343,922 | 9/1994 | Rankl et al. | 160/236 X |

*Primary Examiner*—David M. Purol
*Attorney, Agent, or Firm*—Harness, Dickey & Pierce

[57] ABSTRACT

A shutter is formed of a number of horizontally elongated slats which are pivotally connected together along their adjacent elongated edges so that shutter may be rolled up to expose, or rolled down, to form a panel covering an opening in a building wall. The slats are formed of roughly rectangular in cross-section hollow extrusions having upper and lower edges. Notches are formed in the upper and lower edges to provide upperwardly and downwardly extending tongues on each of the slats. The tongues fit into the notches of the next adjacent slat for overlapping the adjacent tongues. An upwardly extending flange having a hook formation on its end, is formed on the upper edge of each slat and fits into the notch of the lower edge of the next upper slat and pivotally engages a corresponding hook formed on the upper slat. A rigid, elongated insert, formed of a substantially stronger material than the slat material, is snugly fitted within the hollow interior of the slat. The insert is formed in the shape of the interior of the slat and has flange portions that extend into the upper and lower tongues of the slat. The bands of overlapped tongues and the inserts reinforce the slat to resist penetration by forcefully applied objects, such as high wind hurled debris.

12 Claims, 3 Drawing Sheets

FIG-7
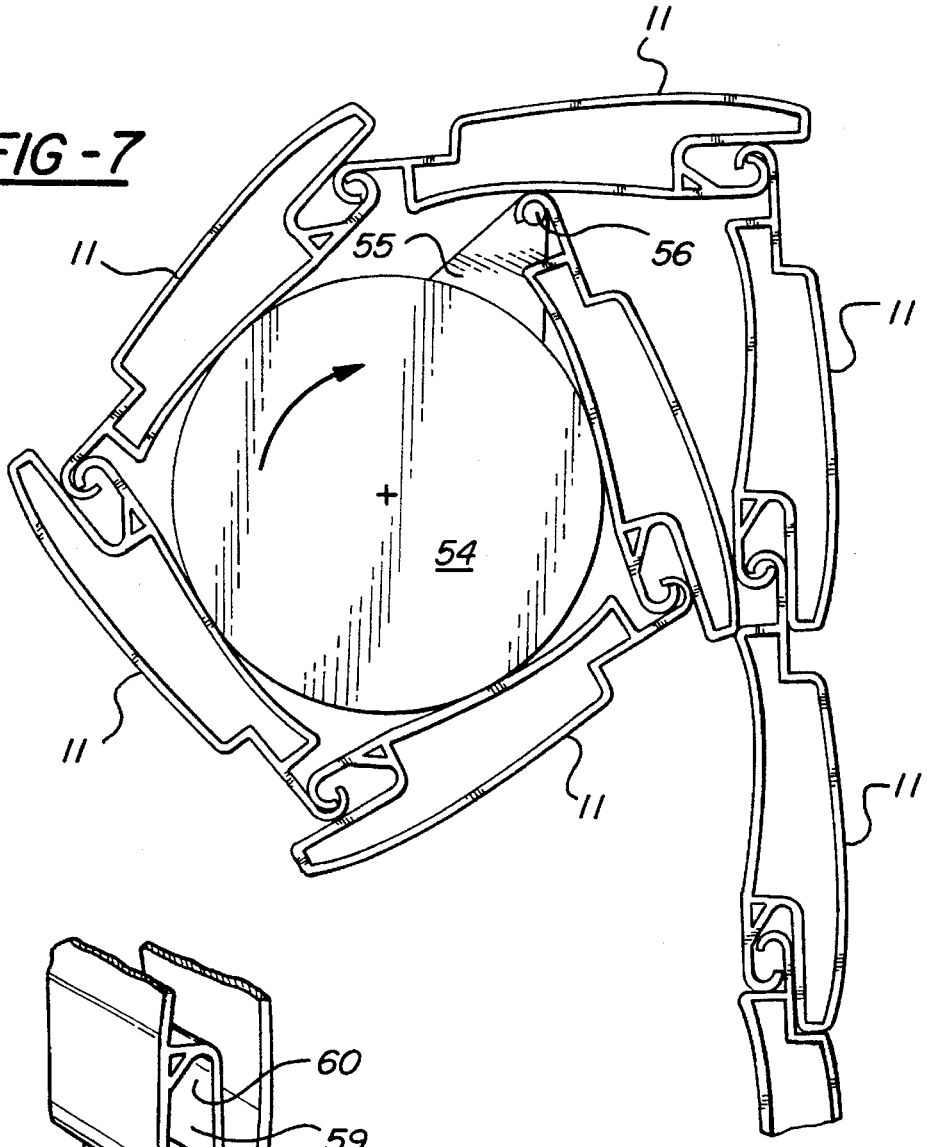
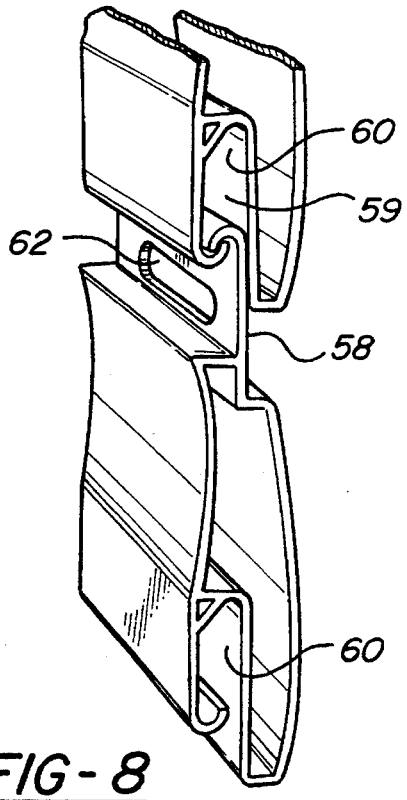
FIG-8
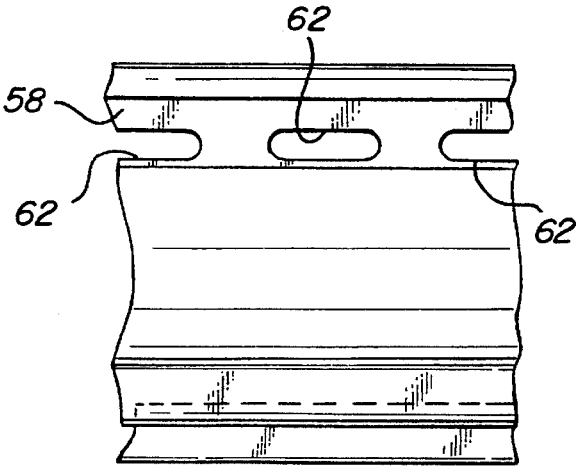
FIG-9

REINFORCED SHUTTER PANEL

BACKGROUND OF INVENTION

This invention relates to a roll-up type of shutter, formed of pivotally connected slats, having reinforcing strips formed along the adjacent edges of the slats for the purposes of resisting penetration by impacting objects.

Roll type shutters are formed, in general, of a series of horizontally elongated, narrow, slats which are pivotally connected together along their adjacent horizontal edges. Thus, the slats may be rolled up around a suitable hub or axle or, alternatively, rolled down to form an articulated panel. Such shutters are normally mounted above a window opening or a door opening or the like in a building structure. Thus, the shutters are either rolled up above the opening, out of the way, or extended downwardly into the panel formation to cover the opening.

Shutters of this type are typically used to cover a building opening to prevent entry of objects or people through the opening. In high wind storm areas, shutters are commonly used to protect window and door openings against wind hurled debris. For example, during hurricanes such type of shutters are used to prevent debris from being thrown through window openings. In such storm areas, the shutters normally are kept rolled up out of the way until needed for protection.

Regardless as to the location in which they are used, the most important function of such shutter panels is to prevent penetration of an opening by forcefully applied objects, whether high wind debris or manually applied objects.

In the past, roll-up type shutters formed of pivotably connected slats have been able to resist a limited amount of force without being penetrated. In recent years, because of severe building damages due to hurricane type storms, the need for stronger, penetration resistant shutters has been recognized. However, to be acceptable to building owners, particularly private home or apartment owners, such shutters must be inexpensive and must appear to be similar to those customarily used in the past. That is, such shutters must not appear to be unusually bulky or unsightly or unattractive.

Thus, the present invention relates to providing a roll-up type of shutter which visually appears to be the same as prior shutters, but which is made with visually unnoticeable reinforcing strips at the intersections between adjacent slats, to provide bar-like horizontal reinforcements across the shutter, and with hidden reinforcing inserts located within each slat.

SUMMARY OF INVENTION

This invention contemplates forming each of the slats in a shutter with an outer-upper L-shaped notch and a lower, inner L-shaped notch which provide upper and lower tongues extending along the opposite edges of each shutter. Adjacent slates are interconnected by an upwardly extending flange formed on the upper edge of each slat, which flange terminates in a downwardly extending hook that is engaged with a corresponding hook formed on a downwardly extending flange formed on the next upper slat. The hooks are located within the respective L-shaped notches of each slat. The engaged hooks are moveable, upwardly and downwardly relative to each other so that each shutter may move upwardly and downwardly a short distance relative to each other. The tongues each fit into the adjacent notches so that the upper tongue of one slat overlaps the lower tongue of the next slat. Thus, the pairs of overlapped tongues form horizontally extended reinforcing bands or strips on the shutter.

Moreover, since commonly used shutter slats are made of hollow plastic extrusions which are relatively weak, this invention contemplates forming a strong metal insert which is shaped to fit within and to substantially fill the interior hollow portion of each slat for substantially strengthening each slat without changing the visual appearance of the slat. Consequently, each slat is reinforced by its interior insert and the interengagement of the respective tongues on adjacent slats reinforces the composite shutter.

The loose pivotal connecting hook connections between the slats enable the slats to move relative to each other, so that the slats may be rolled about a common hub, and also to provide an exposed area having openings which pass light and air.

Accordingly, one of the objects of this invention is to provide a shutter which visually appears to be the same as prior shutters but whose slats have interior reinforcements and edge to edge reinforcing engagements so as to substantially resist penetration caused by the impacts of objects which are wind hurled or manually applied against the shutter.

Another object of this invention is to provide an inexpensive, greatly strengthened, slat-type roll-up shutter which is relatively inexpensive, that is, not much more expensive to make than conventional shutters, but whose appearance is substantially the same as shutters that are customarily used.

Still another object of this invention is to provide a shutter arrangement by which the shutter may be unrolled into a position where slight gaps can be maintained between adjacent slats for the passage of air and light when desired and, yet, the shutter slats may be further moved to provide a tight engagement between the edges of adjacent slats when desired for the purpose of resisting impacts.

These and other objects and advantages of this invention will become apparent upon reading the following description of which the attached drawings form a part.

DESCRIPTION OF DRAWINGS

FIG. 7 is a end view of the upper potion or fragment of a shutter rolled about a central hub.

FIG. 8 is a modified slat, suspended from another slat, having openings provided in its upper flange for the passage of light and air.

FIG. 9 is a front, elevational view of a fragment of the modified slat of FIG. 8 showing the openings formed in the slat upper flange.

DETAILED DESCRIPTION

Figure 1:
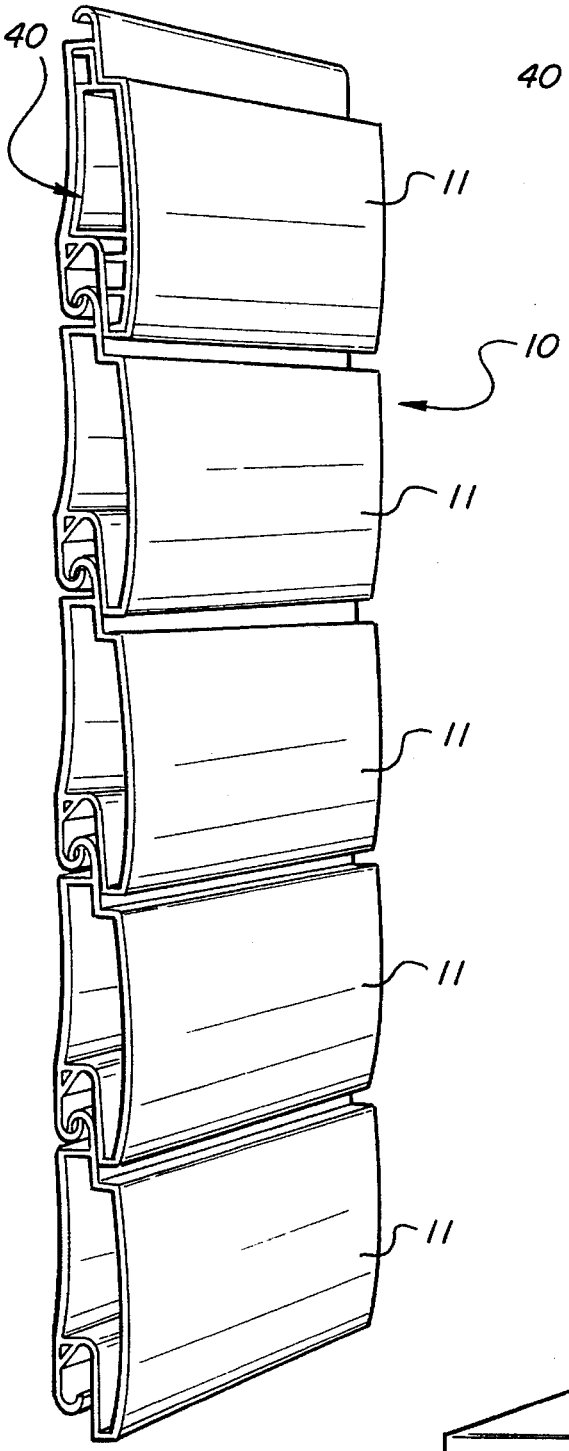
FIG. 1 illustrates a perspective side and front view of a portion of the shutter arranged in panel forming position, with the adjacent slats of the shutter slightly gaped or spaced from each other.
Figure 2:
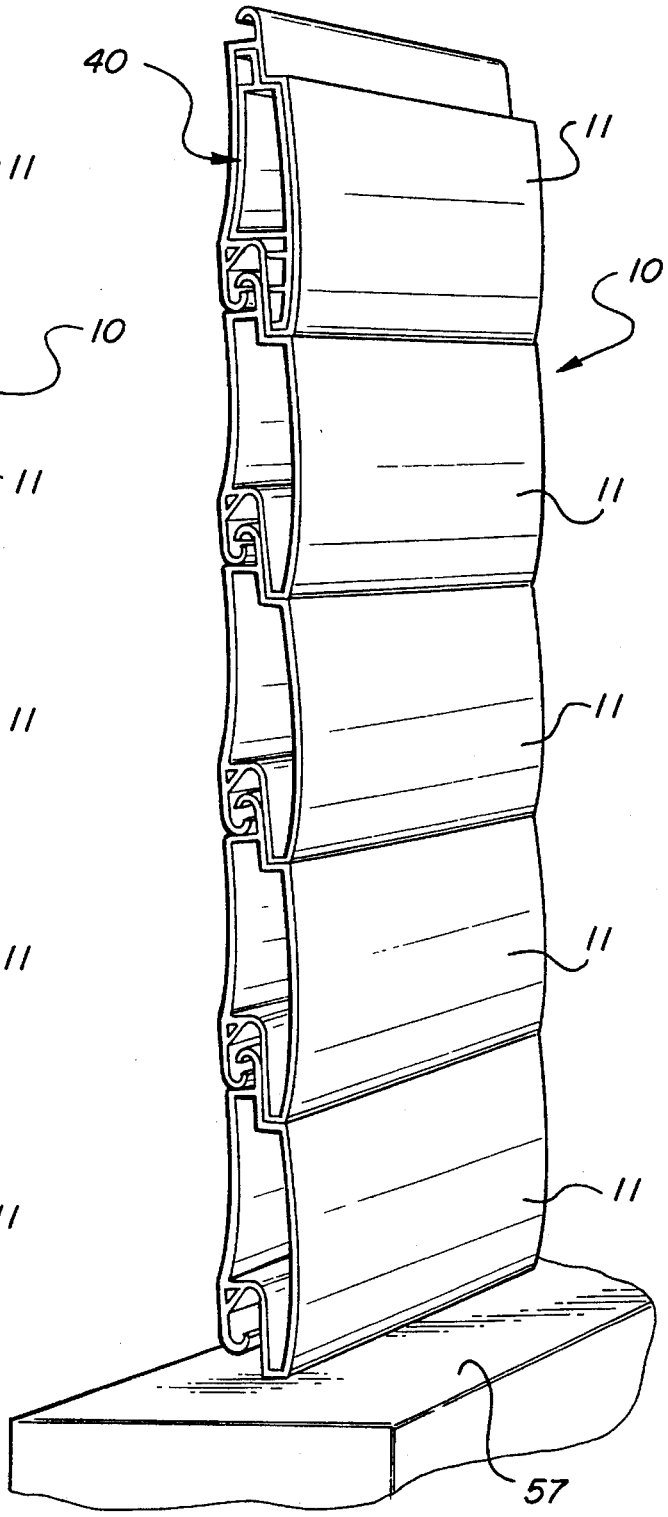
FIG. 2 is a view similar to FIG. 1 showing the shutter in its extended, panel forming position wherein the adjacent edges of the slats are tightly pressed together.

As illustrated in FIGS. 1 and 2, the shutter 10 is formed of numerous slats 11. Each slat is preferably a hollow, plastic extrusion made of any commercially available and suitable plastic material of the type conventional used for slats.

Figure 3:
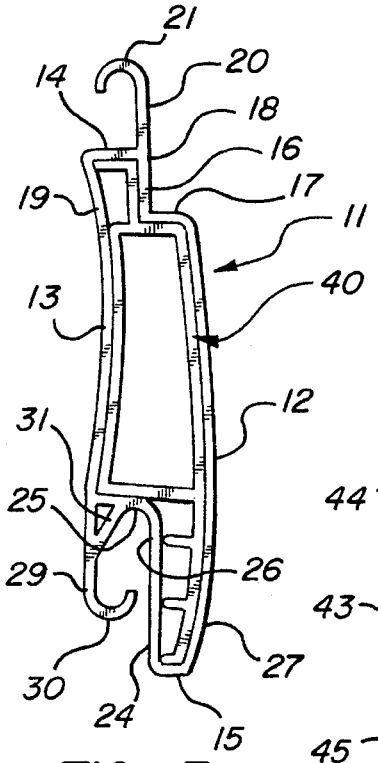
FIG. 3 is an end view of a slat having a slat insert arranged therein.
Figure 4:
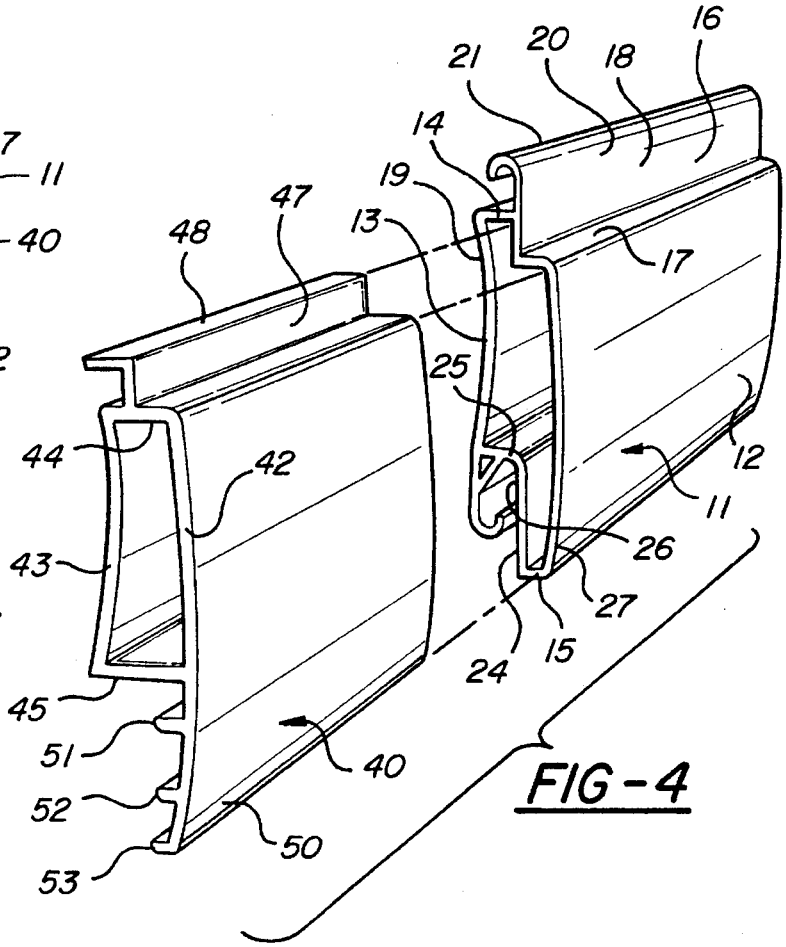
FIG. 4 is a perspective view of a slat with its insert removed and arranged for moving endwise into the slat.
Figure 5:
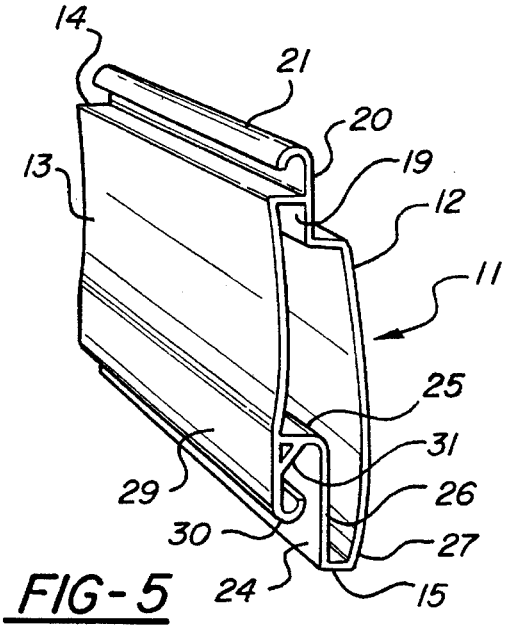
FIG. 5 is a perspective view of an end and the rear face of a slat.

Each slat, as illustrated in FIGS. 3, 4 and 5, has a front wall 12 which may be outwardly bowed or curved slightly and a rear wall 13 which may be slightly concave. The slat is roughly rectangular in cross-section with an upper edge wall 14 and a lower edge wall 15.

Each slat is provided with an upper L-shaped notch 16 formed with a base 17 and a wall 18 which is located in a plane roughly midway between the front and rear walls of the slat.

The upper notch 16 configuration provides an upper tongue 19 on the rear, upper edge portion of the slat. In addition, an upwardly extending integral flange 20 extends from the notch wall 18. The free, upper edge of the flange is bent into a downwardly opening hook 21.

The lower edge portion of each slat is provided with a lower L-shaped notch 24 having a base 25 and a wall 26 located roughly midway between the forward and rear walls of the slat. This notch arrangement provides a lower tongue 27 along the lower, forward portion of the slat.

A lower or downwardly depending flange 29 is formed integral with the rear wall 13 of the slat and extends downwardly a sufficient distance to partially overlap the notch wall 26. Thus, a space or channel is provided between the notch wall 26 and the depending lower flange 29. A bent hook 30 is formed on the free edge of the lower flange 29.

Preferably, an angled brace strip 31 (see FIG. 5) is extruded between the lower flange 29 and the base 25 of the lower notch for reinforcing the slat structure.

Figure 6:
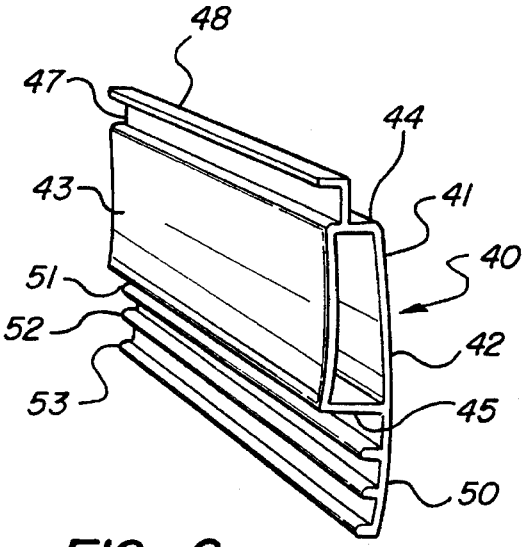
FIG. 6 is a perspective view of the rear face of an insert.

Because the conventional plastic materials that are used for extrusion of slats are relatively weak, that is, they lack the strength to resist high impact forces of debris thrown with hurricane force winds against the shutter, conventional shutters are unable to resist penetration by such objects. The slats of the present construction are provided with interior rigid, strong inserts 40, as illustrated in FIGS. 3, 4 and 6, to resist high impact forces. These inserts are preferably extruded out of a stronger material than that which is used for the slats. For example, a strong aluminum or steel or the like material may be used to form the inserts.

The inserts are each formed with a box-like, hollow body 41 that is formed by an outer wall 42, an inner wall 43, an upper edge wall 44 and a lower edge wall 45. These walls are sized to contact, in substantial face to face contact, the inner surfaces of the slat forward wall 12, rear wall 13, upper notch base 17 and lower notch base 25. This is illustrated in the end view illustrated in FIG. 3.

In addition, the insert has an integral upper flange 47 whose free end is bent to provide a bead or rib 48 which snugly fits within the upper tongue 19 of the slat. A lower flange 50 is formed integral with the insert and is provided with a series of ribs 51, 52, and 53 which are sized to fit within and engage the interior surfaces of the slat lower tongue 27. These spaced ribs form reinforcing columns, or corrugations, which strengthen and rigidify the tongue.

In operation, the slats are formed of continuous extrusions which are cut to lengths corresponding to the width of the shutter panel. Similarly, the inserts are formed of extrusions which are cut to the lengths of the slats. The inserts are each slid endwise into their respective slats. Each of the slats are then hooked to the next adjacent slat by engaging their respective upper and lower hook formations. When loosely suspended from the uppermost slat, the shutter panel formed by the slats appears in a condition similar to that shown in FIG. 1 where the edges of adjacent slats are slightly gaped apart. The uppermost slat may be connected in some suitable mechanical manner to a hub or axial 54. For example, the hook 21 of the uppermost slat can be connected to a bracket 55 having a pin 56 with which the hook is engaged. The bracket is fastened to the hub by a suitable mechanical fastener.

Rotation of the hub by a suitable, conventional mechanism (not shown) causes the shutter to roll around the hub and the slats to move relative to each other to facilitate such rolling action, as illustrated in FIG. 7. The loose connections between the adjacent hook formations permit free swiveling or pivoting of the slats relative to each other and, also, a small amount of upward and downward movement relative to each other.

When the slats are arranged in the panel forming position, as illustrated in FIG. 1, they are suspended or dangled beneath the hub with their adjacent edges slightly gaped apart. They may be left in this position, as will be explained below. However, for reinforcing purposes, the panel may be further moved downwardly until the lowermost slat engages a solid support 57, such as the lower portion or sill of the framing around a window or door opening. The lowermost slat stops when it encounters the solid object. Thus further downward movement of the panel results in the lower tongue of each successive slat abutting the base of the upper notch in the next lower slat, as illustrated in FIG. 2. At that point, the engaged hook formations of the slats may separate with the hooks on the flanges at the upper edges of each slat sliding upwardly relative to the hooks formed on the flange of the lower edges of the slats.

The overlapped tongues, form reinforcing strips or bands which extend horizontally along the panel. These reinforcing strips or bands of overlapped tongues are relatively closely spaced apart because slats of this type are relatively narrow. For example, the slats may be in the order of 2¾ inches in height. The dimensions of the slats may very considerably. However, the relatively low height of each slat results in the adjacent bands of overlapped tongues being relatively close to each other to provide a series of internal reinforcing bar-like configurations The reinforcing bands are greatly strengthened by the inserts positioned within the tongue portions of the slats.

The slats in FIGS. 1, 2, 7 and 8 are illustrated without their interior inserts for simplifying the illustrations. However, the use of such inserts is indicated at the uppermost slats in FIG. 1. and in FIG. 2. Preferably, inserts are used within each of the slats in the shutter.

The slats may be modified, as illustrated in FIGS. 8 and 9, to permit the passage of air and light through the slats when they are gaped apart in their panel forming arrangement. In this configuration, the upper flange 58 of each of the slats is slightly longer in the vertical direction. Similarly, the channels 59 or spaces that are located within the area of the notches 60 located at the bottom of each of the slats is slightly taller or higher. Openings 62, are formed along the upper flanges 58, as illustrated in FIGS. 8 and 9. With this arrangement, when the slats are freely suspended into the panel shape, that is, when the lowermost slat is not stopped, so that the adjacent edges of the slats are slightly gaped, the openings 62 are exposed. Consequently, air and light may pass through the openings. However, the openings are sealed when the slat tongues are closed down against each other, similarly to the arrangement shown in FIG. 2, by stopping the lowermost slat and continuing the downward movement of each of the upper slats until the tongues tightly seat in their respective notches.

To the observer, the construction described above, whether with or without the openings, visually appears to be a conventional shutter construction. The extruded slats may be formed of appropriately colored plastics or may be painted with desired colors so that the slats and the extended shutter panel appear to be conventional. However, the inserts and by the bands of interlocking tongues, although not visible to the observer, produce a strengthened panel which is designed to resist penetration by hurricane hurled debris or by manually forcefully applied objects.

This invention may be further developed within the scope of the following claims. Accordingly, it is desired that the foregoing description be read as being merely illustrative of an operative embodiment of this invention and not in a strictly limited sense.

What is claimed:

1. A roll-up type shutter formed of a number of substantially identical, horizontally arranged, elongated slats pivotally connected together along their adjacent elongated horizontal edges to form a generally vertically arranged panel for covering an opening in a building structure or for rolling up to expose the opening, comprising:

each slat being roughly rectangular in cross-section with a forward wall, rear wall and upper and lower edges; an upper L-shaped in cross section notch formed along the forward wall and upper edge of the slat with the notch opening forwardly and upperwardly to provide an upwardly extending integral, upper tongue along the rear wall and upper edge portion of the slat such that said upper tongue extends beyond said notch in said forward wall; a lower L-shaped notch formed on the rear wall and upper edge of the slat to provide a downwardly extending tongue along the forward wall and lower edge of the slat;

said tongues being sized so that, in use, the lower tongue of one slat overlaps the upper tongue of the next adjacent lower slat and with said tongues fitted into the respective upper and lower notches of the adjacent slats; and each slat having an upper flange, integrally connected to and extending upwardly from the upper edge of the slat;

the rear wall of each slat having a downwardly projecting wall extension which overlaps a substantial part of the lower notch of the slat and with the wall extension having its free end bent upwardly to form a lower support hook such that said downwardly extending tongue extends beyond said lower support hook;

the upper free edge of said upper flange being bent downwardly to form an upper hook which is loosely engaged within said lower support hook to form a pivotal connection between adjacent slats;

the upper hook being upwardly movable into a space located between the wall extension and the portion of the lower notch which is overlapped by the wall extension when the adjacent slats are moved relative to each other;

whereby the overlapped tongues of the slats form spaced apart reinforcing bands extending horizontally across the shutter when the shutter panel covers an opening.

2. A shutter construction as defined in claim 1 and said slats being formed of thin-wall extrusions whereby the vertical wall defining the notch in the lower edge of each slat normally is in substantial face-to-face engagement with the wall defining the notch in the upper edge of the next lower slat when the upper and lower tongues are overlapped.

3. A shutter construction as defined in claim 2 and with the L-shaped notch in the upper edge of each slat having a base and a vertical wall which is located in a plane that is roughly midway between the front and rear wall of the slat, and with the lower edge portion of each slat being moveable into substantial face-to-face contact with the base of the notch in the upper edge of the next lower slat.

4. A shutter construction as defined in claim 2 and with the L-shaped notch in the lower edge of each slat being formed with a base and a wall which is located in a plane that is roughly midway between the forward and rear walls of its slat and which together with said rear wall extension provide a downwardly opening channel into which the upper flange of each slat is loosely fitted and is slidable upwardly and downwardly within said channel, and with the channel being of sufficient depth to enable the lower edge portion of each upper tongue to seat against the base of the notch in the next lower slat.

5. A shutter construction as defined in claim 4 and wherein the slats are arranged to form a panel with the adjacent edges of the slats are spaced apart a short distance from each other so as to expose a portion of said flange between adjacent slats and including openings formed in said exposed flange portions so as to pass air and light therethrough.

6. A shutter construction as defined in claim 2 and including an elongated insert formed of a material which is considerably stronger than the material forming the slats, with each slat having an insert snugly arranged therein, and said inserts having a forward wall which engages the interior surface of the forward wall of the insert and a rear wall which engages the interior surface of the slat rear wall.

7. A shutter construction as defined in claim 6 and said insert having an upper flange arranged within the upper tongue and a lower flange arranged within the lower tongue of its respective slat.

8. A shutter construction as defined in claim 7 and said insert having integral ribs formed on its upper and lower flanges for spanning the spaces between the walls defining each of the tongues of its respective slat for thereby rigidifying such tongues.

9. A shutter construction as defined in claim 8 and said insert having a generally rectangularly shaped, hollow body portion which substantially fills the hollow portion of the respective slat within which the insert is fitted, with the body portion arranged between the forward and rear walls of the slat and having upper and lower edge walls and forward and rear walls engaging the respective interior upper and lower wall surfaces defining the bases of the L-shaped notches to rigidify the walls of the slat.

10. In a roll-type shutter formed of numerous horizontally elongated slats connected together along their adjacent horizontal edges to form a generally vertical arranged panel for covering an opening and which panel may be rolled up for exposing the opening:

each slat having a roughly rectangular in cross-section shape formed of a relatively thin wall extrusion to provide a hollow interior defined by a front wall, a rear wall, an upper and lower edge walls;

an upper L-shaped in cross-section notch formed along the front wall and upper edge of the slat with the notch opening forwardly and upperwardly to provide an upperwardly extending tongue along the rear wall and upper edge portion of the slat;

a lower L-shaped notch formed on the rear wall and lower edge of the slat to provide a downwardly extending tongue along the forward wall and lower edge of the slat;

said tongues being sized so that the lower tongue of one slat substantially overlaps the upper tongue of the next adjacent lower slat and said tongues fit into the respective upper and lower notches of their adjacent slats;

each slat having an upper flange which is integrally connected to and extends upwardly from the upper edge of the slat and which terminates in a downwardly extending hook portion; and the rear wall of each slat having a depending wall extension which partially overlaps a portion of the lower notch of the slat to provide a downwardly opening channel therebetween, with the wall extension terminating in an upperwardly bent hook;

with the hook on the flange of one slat being engaged with the hook on the wall extension of the next higher slat to provide a loose pivotal connection between adjacent slats wherein the hooks may loosely separate so that the hook on the flange may move upwardly into the channel during the rolling of the shutter; and an insert formed of an extrusion made of a material that has considerable greater strength than the material of which the slat is formed, with the insert having a box-like body portion which snugly fits into the hollow interior of a slat and the insert further having an upwardly extending flange and a downwardly extending flange for respectively fitting into the upper and lower tongues of its slat and having flange portions which span the spaces within said tongues for rigidifying the interior of the respective slats.

11. A shutter construction as defined in claim 10 and wherein the upperwardly extending flanges on each slat are sufficiently sized to enable the slats to be slightly gaped apart at their adjacent edges when arranged in the panel forming position of the shutter so as to expose a small portion of said flange between adjacent slats;

openings formed in the exposed portions of the flanges for enabling the passage of air and light therethrough; and wherein the slats may be moved into a position wherein the tongues substantially fill their respective notches in the adjacent slats for closing said openings.

12. A shutter construction as defined in claim 11 and wherein said shutters normally hang loosely, one beneath the next, from their interengaging hooks with their adjacent edges slightly gaped apart; and a bottom stop member against which the lowermost slat may engage so that further downward movement of each of the slats relative to each other results in the tongues of each slat bottoming into the bottom of the next lowermost notch.

* * * * *

UNITED STATES PATENT AND TRADEMARK OFFICE

CERTIFICATE OF CORRECTION

PATENT NO. : 5,515,902

DATED : May 14, 1996

INVENTOR(S) : Robert L. Hoffman

It is certified that error appears in the above-indentified patent and that said Letters Patent is hereby corrected as shown below:

Column 5, line 40, after "slat" insert --substantially fully--.

Signed and Sealed this

Twenty-fifth Day of February, 1997

*Attest:*

Bruce Lehman

BRUCE LEHMAN

*Attesting Officer*

*Commissioner of Patents and Trademarks*